US008686814B2

(12) United States Patent
Bach et al.

(10) Patent No.: US 8,686,814 B2
(45) Date of Patent: Apr. 1, 2014

(54) ELECTRIC SWITCHING DEVICE WITH ULTRA-FAST ACTUATING MECHANISM AND HYBRID SWITCH COMPRISING ONE SUCH DEVICE

(75) Inventors: Julien Bach, Saint Etienne de Saint Geoirs (FR); Cédric Bricquet, Meylan (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 13/639,726

(22) PCT Filed: Apr. 15, 2010

(86) PCT No.: PCT/FR2010/000304

§ 371 (c)(1),
(2), (4) Date: Oct. 5, 2012

(87) PCT Pub. No.: WO2011/128516

PCT Pub. Date: Oct. 20, 2011

(65) Prior Publication Data

US 2013/0027158 A1 Jan. 31, 2013

(51) Int. Cl.
*H01H 77/00* (2006.01)

(52) U.S. Cl.
USPC ..... 335/16; 335/131

(58) Field of Classification Search
USPC ..... 335/136
See application file for complete search history.

(56) References Cited

U.S. PATENT DOCUMENTS

| | | | | |
|---|---|---|---|---|
| 3,728,654 | A * | 4/1973 | Tada | 335/234 |
| 4,272,661 | A * | 6/1981 | Dethlefsen | 218/142 |
| 4,292,611 | A | 9/1981 | Bresson et al. | |
| 4,928,028 | A * | 5/1990 | Leibovich | 310/23 |
| 6,046,423 | A * | 4/2000 | Kishida et al. | 218/154 |
| 6,199,587 | B1 * | 3/2001 | Shlomi et al. | 137/625.5 |
| 8,138,440 | B2 * | 3/2012 | Onufriyenko et al. | 218/154 |
| 8,228,149 | B2 * | 7/2012 | Puth et al. | 335/229 |
| 2002/0044403 | A1 | 4/2002 | Takeuchi et al. | |
| 2004/0026457 | A1 | 2/2004 | Petit | |
| 2006/0130785 | A1 * | 6/2006 | Han et al. | 123/90.11 |

FOREIGN PATENT DOCUMENTS

| | | |
|---|---|---|
| EP | 0 017 575 | 10/1980 |
| FR | 2 333 337 | 6/1977 |
| FR | 2 815 611 | 4/2002 |
| FR | 2 867 304 | 9/2005 |
| WO | WO 03/056586 A1 | 7/2003 |

* cited by examiner

*Primary Examiner* — Shawki Ismail
*Assistant Examiner* — Lisa Homza
(74) *Attorney, Agent, or Firm* — Steptoe & Johnson LLP

(57) ABSTRACT

A switching device having an ultra-fast actuating mechanism for opening electric contacts, the device having a propulsion coil and a conducting disk. A stationary contact collaborates in a closed position with a movable contact, said contacts being moved to an open position by repulsion of the conducting disk. A biasing device generates a closing force to hold the electrical contacts in the closed position. Latching means, for maintaining the movable contact in the open position, includes a magnetic yoke having an attraction coil providing an attraction force of a magnetic movable armature. The movable contact is supported by a contact-bearing support having drive means collaborating with the magnetic movable armature to cause movement thereof when movement of the movable contact takes place.

6 Claims, 4 Drawing Sheets

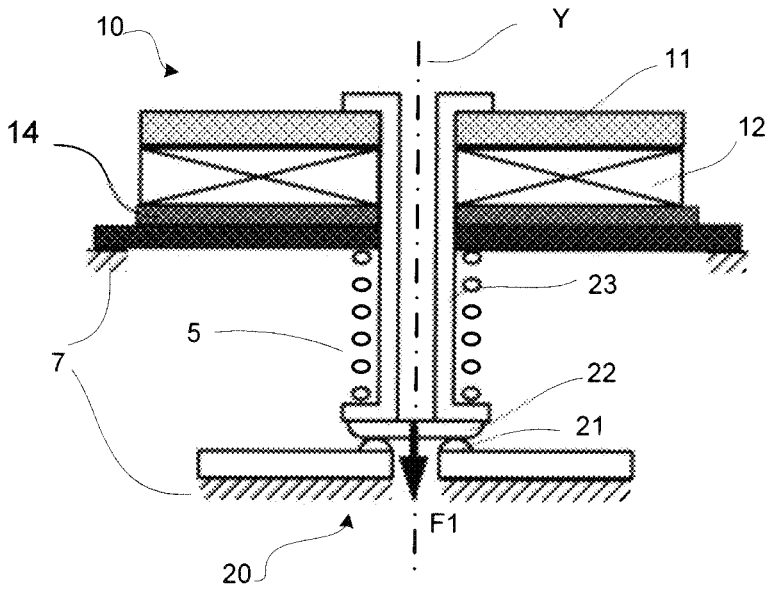
FIGURE 1A (State of the art)
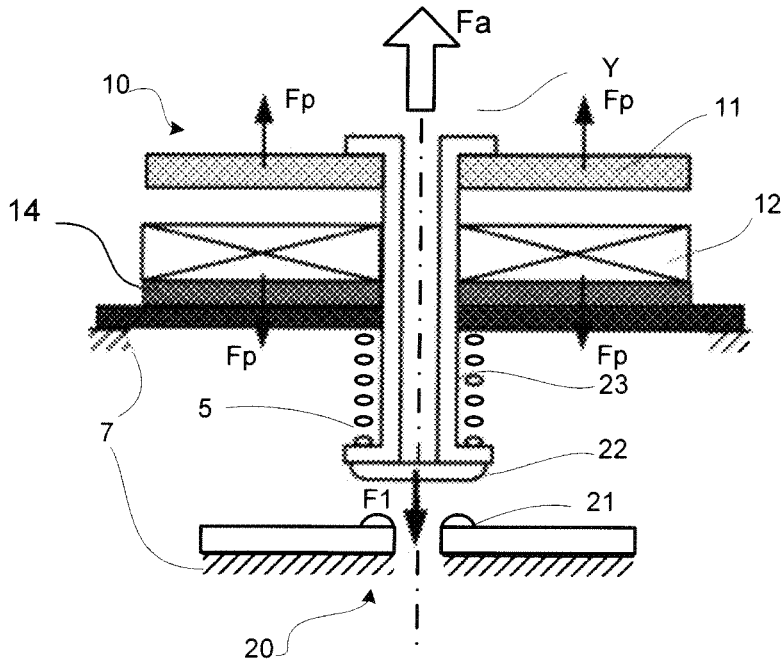
FIGURE 1B (State of the art)

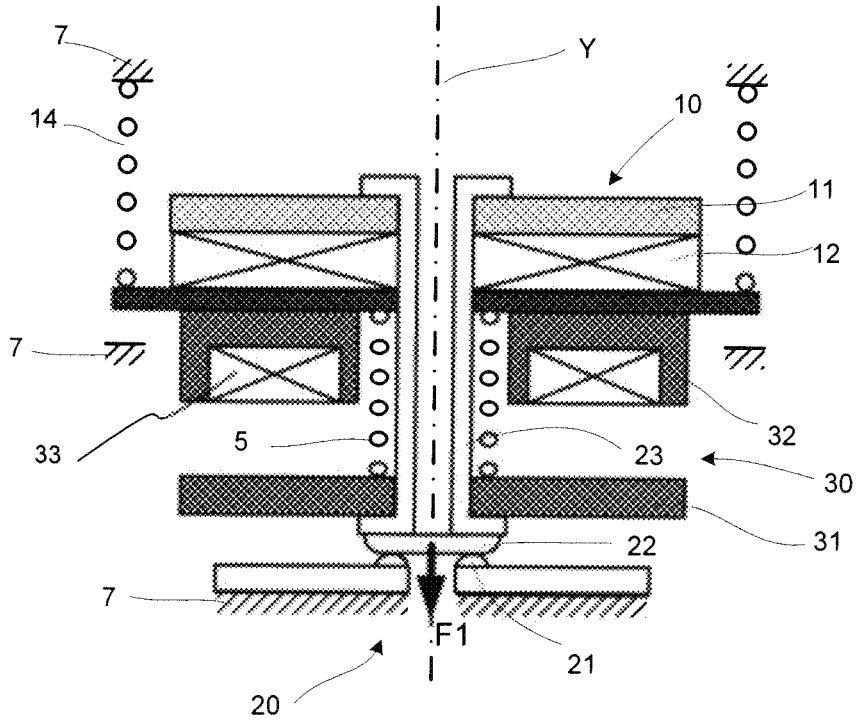
FIGURE 2A (State of the art)
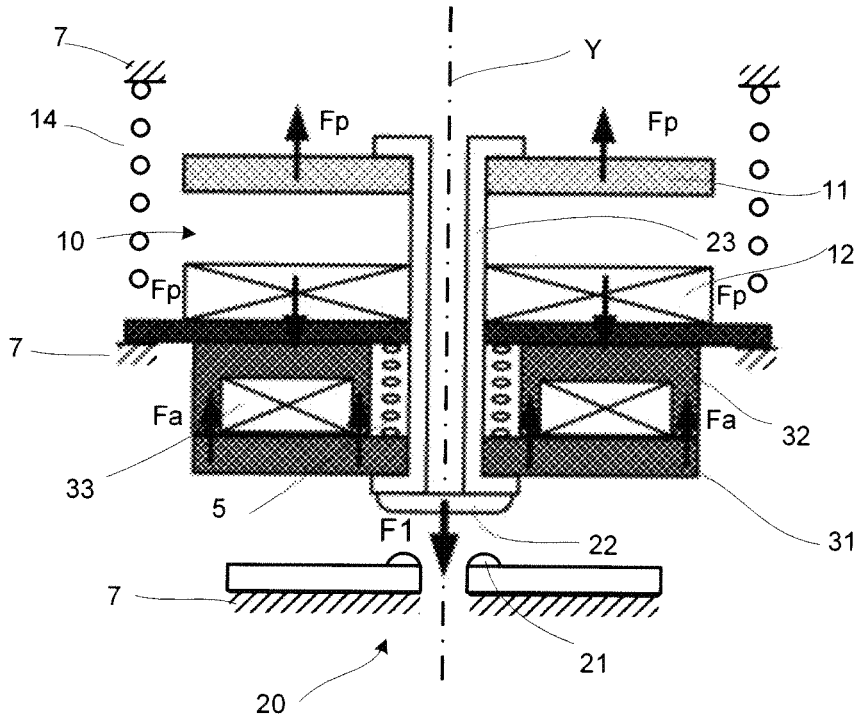
FIGURE 2B (State of the art)

ELECTRIC SWITCHING DEVICE WITH ULTRA-FAST ACTUATING MECHANISM AND HYBRID SWITCH COMPRISING ONE SUCH DEVICE

This application is a national stage entry of International Application No. PCT/FR2010/000304, filed Apr. 15, 2010.

BACKGROUND OF THE INVENTION

The invention relates to an electric switching device with an ultra-fast actuating mechanism for opening electric contacts. The mechanism comprises an electro-dynamic trip unit having a propulsion coil associated with a conducting disk. A stationary contact collaborates in the closed position with a movable contact, said electric contacts being moved to the open position by propulsion of the conducting disk when the propulsion coil is supplied with power. A biasing device is designed to generate a closing force to keep said electric contacts in the closed position. Latching means of the movable contact in the open position comprise a magnetic yoke having an attraction coil designed to provide an attraction force of a movable magnetic armature. Said armature is designed to be driven in movement by the movable contact so as to come into contact with the fixed magnetic yoke.

The invention also relates to a hybrid current interruption switch comprising mechanical opening means and electric opening means in parallel.

STATE OF THE ART

The use of an ultra-fast contact opening or closing actuating mechanism is described in particular in Patent applications (FR-A-2815611, US2002/0044403 A1, W003/056586 A1).

In known manner, as represented in FIG. 1, the switching device comprises a contactor unit 20 having a stationary contact 21 collaborating with a movable contact 22 supported by a contact-bearing support 23. The electric contacts are respectively connected to the electric terminals of an external electric circuit to be switched. Opening and closing control of the contacts, in other words movement of the movable contact, is actuated by an actuating mechanism.

The object sought to be achieved by such devices is ultra-fast opening and closing of the contacts.

Certain solutions propose actuating mechanisms having a conventional Thomson effect electrodynamic trip unit. As represented in FIGS. 1 and 2, the electrodynamic trip unit 10 comprises a coil called propulsion coil 12 associated with a conducting disk 11. Said disk is arranged in the closed position facing and at a small distance from a surface of the winding of the propulsion coil 12. The propulsion coil 12 is either fixed with respect to the frame 7 of the device or supported by a contact wear compensation system 14. The compensation system can for example comprise a foam, an elastomer or a spring.

The switching device comprises a biasing device 5 of the movable assembly formed by the conducting disk 11—contact-bearing support 23 in the closed position of said electric contacts 21, 22, said device generating a closing force F1.

To open the contacts, an electric current flows through the propulsion coil 12 and generates a magnetic field which produces an electrodynamic repulsion force Fp which repels the conducting disk 11 in a direction parallel to its axis of revolution Y. Movement of the conducting disk 11 at the same time causes movement of the contact-bearing support 23 and of the movable contact 22 and therefore opening of the electric contacts of the switching device. This type of mechanism is used for its simplicity of implementation and for its low production cost.

Another very effective solution that is not represented consists in placing a second coil in the place of the conducting disk. The repulsion forces created by the two coils are then used jointly for ultra-fast movement of the movable contact via the second moving coil. The two coils are then configured so as to create opposing electrodynamic repulsion forces. Each coil generates a magnetic field which produces an electrodynamic repulsion force which tends to repel the other coil. Under the combined effect of the two repulsion forces, the movable coil will move slightly less quickly but presents other advantages. The main advantage of this kind of device is that repulsion forces can be created independently from the wave shape of the propulsion current as is the case of a conventional Thomson effect propeller. The currents do not have to be induced by generation of a Foucault current in a secondary such as a solid disk for the repulsion force to express itself. All these types of device can be used on an ultra-fast opening electromechanical circuit breaker thus enabling very high short-circuit current limiting to be achieved. Furthermore, the double-coil device can be used in asymmetric form or with coils of different shapes. It can also be complexified at the level of its electronic control. More sophisticated electronics give access to higher-level functionalities which enable the device to be better controlled. The movement travel of the movable coil can in particular be controlled, being able to be slowed-down or speeded-up in either direction. This variation of slowing-down/speeding-up can be obtained either by control of the repulsion force with respect to the biasing force, or by a combination of this first control with separate regulation of the currents when twin-coil propulsion is involved.

It is also possible to envisage means for holding the contacts in the open position. These holding or latching means generate a force holding the contact-bearing support 23 and the movable contact 22 in an open position of the electric contacts of the switching device.

The latching means can be of electromagnetic type as described in the Patent filed by the applicant FR2867304. As represented in FIG. 2B, holding of the contacts 21, 22 in the open position is obtained by means of an additional electromagnetic attraction force. Latching means 30 of the movable assembly formed by the conducting disk 11—contact-bearing support 23—movable contact 22 in the open position then comprise a movable magnetic armature 31 designed to collaborate by attraction with a magnetic yoke 32 when excitation of an attraction coil 33 takes place. The movable magnetic armature 31 is mechanically connected to the movable assembly formed by the conducting disk 11—contact-bearing support 23—movable contact 22. As an example embodiment, a non-deformable rigid rod connects the movable assembly formed by the conducting disk 11—contact-bearing support 23—movable contact 22 to the movable magnetic armature 31. Any movement of said assembly then at the same time results in movement of the movable magnetic armature 31 and vice-versa. These electromagnetic latching means present the drawback of increasing the weight of the set of means propelled by the propulsion coil, the increased weight of the moving parts acting unfavourably on the opening speed.

The latching means can also be of mechanical type using for example a latching pin. When the latching means are mechanical, they can present the drawback of generating additional friction.

SUMMARY OF THE INVENTION

The object of the invention is therefore to remedy the drawbacks of the state of the art so as to propose a switching device comprising an ultra-fast actuating mechanism and efficient magnetic latching means.

The movable contact of the electric switching device according to the invention is supported by a contact-bearing support comprising drive means designed to collaborate with the magnetic movable armature when movement of the movable contact takes place. Bringing said drive means into contact with the magnetic movable armature results in movement of the latter in the direction of the magnetic yoke.

According to a mode of development of the invention, the contact-bearing support is securedly attached to the conducting disk, the drive means of the assembly being positioned on the conducting disk.

Preferably, the drive means are designed to come into contact with the magnetic movable armature to drive the latter in movement when the distance between the movable contact and the stationary contact is at least greater than 50% of the total opening distance of said contacts.

According to a mode of development of the invention, the latching means comprise holding means designed to hold the movable assembly formed by the conducting disk—contact-bearing support—movable contact in the open position, the attraction force being applied to said assembly via the holding means.

Advantageously, the holding means comprise a pin which collaborates with a location arranged on the contact-bearing support to prevent the movable assembly formed by the conducting disk—contact-bearing support—movable contact from returning to the closed position.

Preferably, the attraction force provided by the attraction coil of the magnetic yoke is of higher intensity than the closing force provided by the biasing device.

Preferably, the magnetic movable armature comprises a magnetic disk designed to be located in the open position facing and at a small distance from a surface of the attraction coil and in contact with the magnetic yoke.

The invention relates to a hybrid current interruption switch comprising mechanical opening means and electric opening means in parallel. The mechanical opening means are formed by an electric switching device as defined in the foregoing.

BRIEF DESCRIPTION OF THE DRAWINGS

Other advantages and features will become more clearly apparent from the following description of a particular embodiment of the invention, given for non-restrictive purposes only, and represented in the appended drawings in which:

FIGS. 1A and 1B represent schematic cross-sectional views of switching devices according to the state of the art;

FIGS. 2A and 2B represent schematic cross-sectional views of a known switching device including a magnetic latching;

DETAILED DESCRIPTION OF AN EMBODIMENT

Figure 3A:
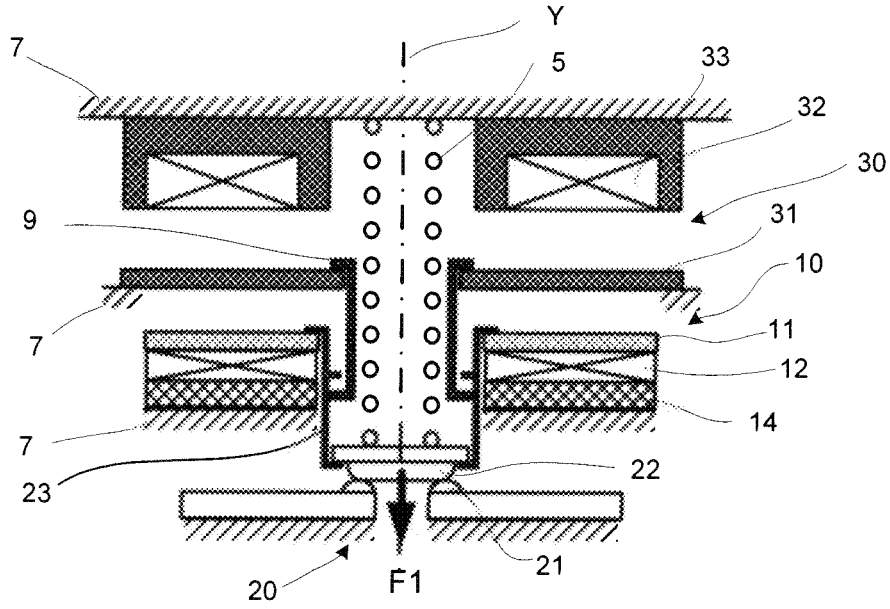
FIG. 3A represents a schematic cross-sectional view of a switching device according to a preferred embodiment of the invention in the closed position.
Figure 3B:
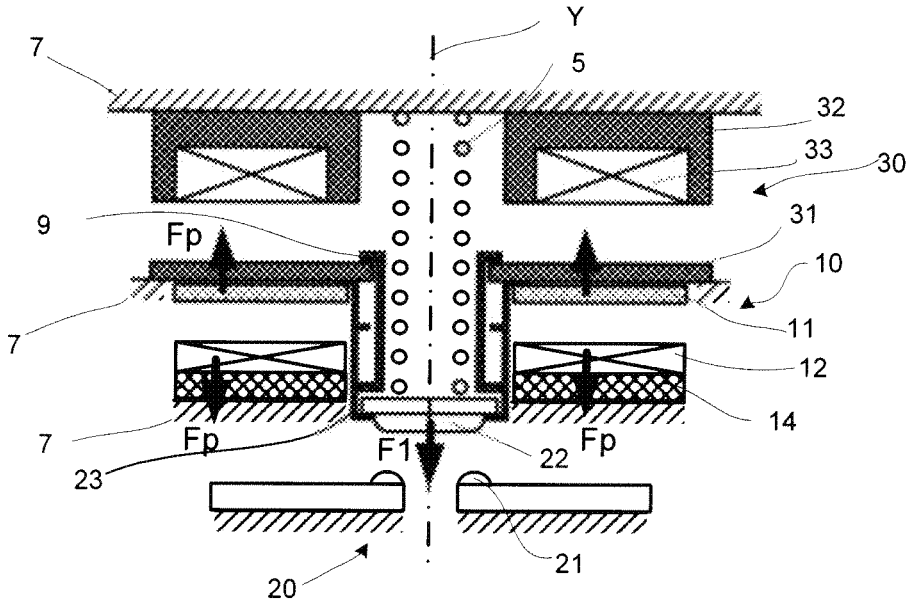
FIG. 3B represents a schematic cross-sectional view of the device according to FIG. 3A in the course of opening.
Figure 3C:
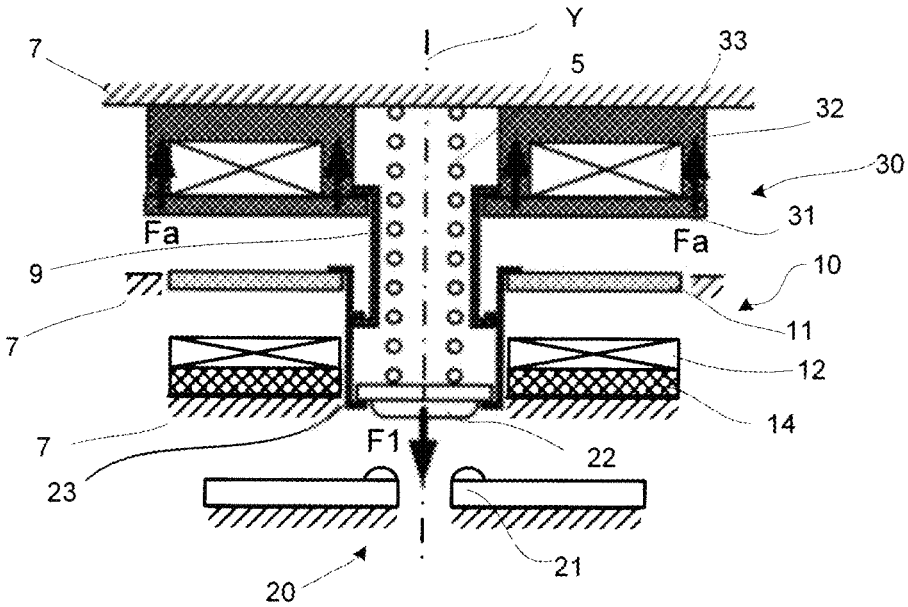
FIG. 3C represents a schematic cross-sectional view of the device according to FIG. 3A in the open position.

According to a preferred embodiment of the invention as represented in FIGS. 3A to 3C, the electric switching device 1 with ultra-fast actuating mechanism for opening electric contacts 21, 22 comprises an electrodynamic trip unit 10.

Said trip unit comprises a propulsion coil 12 associated with a conducting disk 11. As represented in FIG. 3A, said conducting disk is located in the closed position facing and at a small distance from a surface of the winding of the propulsion coil 12. In the closed position of the electric contacts 21, 22, the conducting disk 11 is preferably in contact with the surface of the winding of the propulsion coil 12. In an example embodiment, the external diameter of the conducting disk 11 is at least equal to the external diameter of the propulsion coil 12.

According to a particular embodiment, the axes of revolution Y of the propulsion coil 12 and of the conducting disk 11 are identical or aligned.

According to a particular embodiment, the propulsion coil 12 is connected to the frame 7 via a wear compensation system 14. The wear compensation system 14 enables the propelled conducting disk 11 to be held, in the closed position, as close as possible to the propulsion coil 12 whatever the state of wear of the electric contacts.

Said trip unit comprises a contactor unit 20 having a stationary contact 21 collaborating with a movable contact 22. The movable contact 22 is connected to the conducting disk 11 by means of a contact-bearing support 23. Any translational movement of the conducting disk 11 along its axis of revolution Y is thus integrally transmitted to the movable contact 22 which moves along the same axis.

Said trip unit comprises a biasing device 5 designed to generate a closing force F1 to hold said electric contacts 21, 22 in the closed position. According to a particular embodiment, the biasing device 5 preferably comprises a helical spring. As represented in FIGS. 3A to 3C, this spring tends to compress at the time opening of the electric contacts 21, 22 takes place. The closing force F1 is then a compression force applied on the movable assembly formed by the conducting disk 11—contact-bearing support 23—movable contact 22.

Said trip unit comprises latching means 30 of the movable contact 22 in the open position. Said latching means are designed to hold the movable assembly formed by the conducting disk 11—contact-bearing support 23—movable contact 22 in an open position of the electric contacts 21, 22. According to an embodiment of the invention, the latching means 30 comprise a fixed magnetic yoke 32 having an attraction coil 33 designed to be electrically supplied to provide an electro-magnetic attraction force Fa.

The latching means 30 further comprise a magnetic movable armature 31 designed to come into contact with the fixed magnetic yoke 32. The magnetic movable armature 31 is driven in movement by the movable contact 22, driving of said armature being direct or indirect. According to a particular embodiment, the movable assembly formed by the conducting disk 11—contact-bearing support 23—movable contact 22 is designed to drive the magnetic movable armature 31 to bring about movement the latter.

As an example embodiment, the magnetic yoke 32 has an annular shape. The attraction coil 33 is positioned inside the open ring. The magnetic movable armature 31 comprises a magnetic disk designed to collaborate with the magnetic yoke 32 in order to reclose the open ring. The fixed magnetic yoke 32 associated with the magnetic movable armature 31 thus forms a magnetic circuit. The magnetic field lines generated by the attraction coil 33 loop back in the magnetic circuit passing through the air-gaps present at the level of the contact areas between said yoke and said armature.

According to a preferred mode of operation of the invention, the electromagnetic attraction force Fa provided by said attraction coil 33 is designed to hold the magnetic movable armature 31 and the movable assembly formed by the conducting disk 11—contact-bearing support 23—movable contact 22 in the open position. The electromagnetic attraction force Fa provided by the attraction coil 33 of the magnetic yoke 32 opposes the closing force F1 provided by the biasing device 5. Furthermore, the latching force Fa is of greater intensity than a closing force F1 provided by the biasing device 5 in the closed position. According to a preferred embodiment of the invention as represented in FIGS. 3A, 3B and 3C, the latching means 30 comprise holding means 9 designed to hold the movable assembly formed by the conducting disk 11—contact-bearing support 23—movable contact 22 in the open position. As an example embodiment, the holding means 9 can comprise a pin which collaborates with a location arranged on the contact-bearing support 23 to prevent said movable assembly from returning to the closed position.

According to a particular operating mode, the electromagnetic attraction force Fa provided is also designed to attract the magnetic movable armature 31 to a position against the magnetic yoke 32. The electromagnetic attraction force Fa supplied by the attraction coil 33 thus favours movement of the magnetic movable armature 31 and can cause movement thereof before the movable assembly formed by the conducting disk 11—contact-bearing support 23—movable contact 22 comes into contact with said armature to cause movement of the latter.

In a preferred first phase of operation of the switching device, said electric contacts 21, 22 are moved to the open position by repulsion of the conducting disk 11 when power is supplied to the propulsion coil 12. When an electric current flows through the propulsion coil 12, the latter in fact generates a magnetic field which produces an electromagnetic repulsion force Fp. For example purposes, the electric pulse is delivered by an energy source, in particular a pulsed source, which can be formed by a previously charged capacitor. The repulsion force Fp repels the conducting disk 11 in a direction parallel to its axis of revolution Y. Movement of the conducting disk 11 at the same time causes movement of the contact-bearing support 23 and of the movable contact 22. Said movable contact leaves the closed position. The intensity of the repulsion force Fp is much greater than the intensity of the closing force F1 exerted by the flexible means of the biasing device 5 whatever the position of the movable assembly formed by the conducting disk 11—contact-bearing support 23—movable contact 22 (Fp>>F1). Separation of the electric contacts 21, 22 is thus performed with a minimal mass to be moved. The acceleration of the movable assembly formed by the conducting disk 11—contact-bearing support 23—movable contact 22 is maximal. In the course of this first operating phase, movement of the movable assembly formed by the conducting disk 11—contact-bearing support 23—movable contact 22 is entirely independent from that of the magnetic movable armature 31. Said assembly in fact performs a free travel during which the movable contact 22 moves to the open position. What is meant by "free travel" is thus the fact that the movable assembly formed by the conducting disk 11—contact-bearing support 23—movable contact 22 moves without causing movement of the magnetic movable armature 31.

A second phase of operation begins when the distance between the movable contact 22 and the stationary contact 21 is sufficient. Said movement of the movable contact 22 is considered as being sufficient when the distance or the separating gap between the movable contact 22 and stationary contact 21 enables electric current interruption to be performed. At this stage of operation, the contact-bearing support 23 connected to the movable contact 22 comprises drive means which come into contact with the magnetic movable armature 31 to move the latter.

As an example embodiment, driving of the magnetic movable armature 31 in movement begins when the contact-bearing support 23 has moved so that the distance between the movable contact 22 and the stationary contact 21 is at least greater than 50% of a total opening distance of the electric contacts 21, 22.

As an example embodiment, the contact-bearing support 23 being securedly attached to the conducting disk 11, the drive means are positioned on the conducting disk 11 to come directly into contact with a surface of the magnetic disk of the magnetic movable armature 31. Due to storage of kinetic energy in the movable assembly formed by the conducting disk 11—contact-bearing support 23—movable contact 22, a shock between the drive means and said magnetic movable armature 31 causes movement of said armature against the magnetic yoke 32. As an example embodiment, the respective masses of the movable assembly formed by the conducting disk 11—contact-bearing support 23 and the magnetic movable armature are substantially equal. On account of his equilibrium of masses, the shock between said drive means and said armature causes on the one hand a very strong acceleration of the magnetic movable armature 31 and on the other hand a very considerable slowing-down of the movable assembly formed by the conducting disk 11—contact-bearing support 23—movable contact 22.

In a third phase of operation, the electrically supplied attraction coil 33 provides an attraction force Fa. The attraction force Fa is applied to the movable assembly formed by the conducting disk 11—contact-bearing support 23—movable contact 22 via the holding means 9 of the latching means 30. In this way, at the end of the second phase of operation, the positioning of the magnetic movable armature 31 against the magnetic yoke 32 enables the movable assembly formed by the conducting disk 11—contact-bearing support 23—movable contact 22 to be held in the open position against the closing force F1. So long as the attraction coil 33 is supplied with power, the magnetic movable armature 31 then remains latched to the magnetic yoke 32 and then prevents the movable contact 22 from returning to the closed position. As represented in FIG. 3C, the holding means 9 securedly attached to the magnetic movable armature 31 keep the movable assembly formed by the conducting disk 11—contact-bearing support 23—movable contact 22 in the open position. Furthermore, during this third phase, the propulsion coil 12 is no longer supplied and the propulsion force Fp is then zero. Said electric contacts 21, 22 are kept in the open position by means of the latching means 30 exerting an electromagnetic attraction force Fa. Said electromagnetic attraction force Fa is of greater intensity than the closing force F1 exerted by the flexible means of the biasing device 5 in the closed position (Fa>>F1).

In a fourth phase of operation, the attraction coil 33 is no longer supplied, and the attraction force Fa is then zero. The movable contact 22 can then move back into contact with the stationary contact 21 due to the effect of the closing force F1.

The movable assembly formed by the conducting disk 11—contact-bearing support 23—movable contact 22 reverts to its closed position and the electric contacts 21, 22 are therefore again closed. The switching device reverts to a stable closed position.

According to a particular mode of operation of the switching device, the magnetic movable armature 31 begins a slow movement during the first phase of operation. The attraction coil 33 of the magnetic yoke 32 is supplied and performs attraction of the magnetic movable armature. This magnetic movable armature 31 receives the subsequent kinetic energy stored by the assembly formed by the conducting disk 11—contact-bearing support 23—movable contact 22 at the time the shock takes place and continues its travel until it comes into contact with the magnetic yoke 32.

Advantageously, the switching device of the invention enables the weight of the moving parts propelled by the propulsion force to be reduced. At the beginning of movement of the assembly formed by the conducting disk 11—contact-bearing support 23—movable contact 22, the latching means 30 not yet being securedly attached to the movable assembly do not in fact tend to slow down opening of the movable contact 22.

Figure 4:
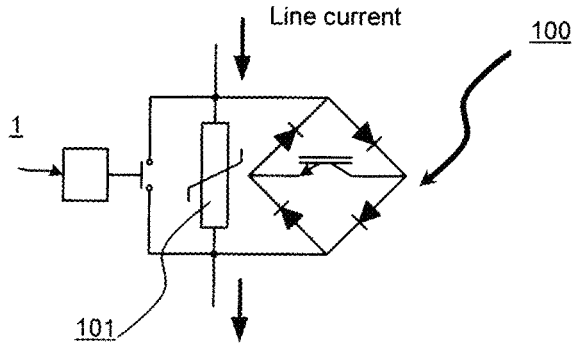
FIG. 4 represents a schematic view of a hybrid switch according to the invention.

As represented in FIG. 4, the invention concerns a hybrid current interruption switch. The hybrid current interruption switch comprises mechanical opening means 1 connected in parallel with electric opening means 100 called solid-state means. The mechanical opening means 1 are formed by an electric switching device as defined in the foregoing.

The electric opening means 100 are designed to ensure very fast electronic breaking and to thus be an extremely limiting opening means. The energy of the breaking circuit is mainly absorbed in at least one varistor 101. The solid-state opening means 100 do however present a low heat dissipation capacity in nominal operation. This problem inherent to operation of solid-state opening means requires said opening means to coupled with another type of breaking means such as in particular mechanical breaking means 1.

According to a particular embodiment of the invention, the solid-state electric opening means 100 are those of an ultra-fast solid-state circuit breaker as described in the Patent FR 2651915 filed by the applicant.

The objective of breaking called hybrid is thus to eliminate the drawbacks of solid-state opening means 100 while keeping the advantages of the latter. The electric contacts 21, 22 in the closed position of the mechanical opening means 1 thus ensure current flow in normal operating conditions. In case of detection of an electric fault, the electric contacts 21, 22 open sufficiently quickly to transfer the current onto the circuit of the solid-state opening means 100 which then takes charge of electric current breaking and absorption of the short-circuit energy in the varistor 101.

The invention claimed is:

1. An electric switching having with an ultra-fast actuating mechanism for opening electrical contacts, said device comprising:

an electrodynamic trip unit comprising a propulsion coil associated with a conducting disk, a stationary electrical contact for collaborating in a closed position with a movable electrical contact, said movable electrical contact being movable to an open position by propulsion of the conducting disk when the propulsion coil is supplied with power, a biasing device for generating a closing force to keep said electrical contacts in a closed position, latching means for maintaining the movable contact in the open position, said means comprising a fixed magnetic yoke having an attraction coil for providing an attraction force to a movable magnetic armature, said armature for being driven in movement by the movable contact to come into contact with the fixed magnetic yoke, wherein the movable contact is supported by a contact-bearing support comprising drive means for collaborating with the magnetic movable armature when movement of the movable contact takes place, thereby bringing said drive means into contact with the magnetic movable armature resulting in movement of the magnetic movable armature in the direction of the fixed magnetic yoke.

2. The electric switching device according to claim 1, wherein the contact-bearing support is securely attached to the conducting disk, the drive means being positioned on the conducting disk.

3. The electric switching device according to claim 1, wherein the drive means are for coming into contact with the magnetic movable armature for driving the magnetic movable armature in movement when the distance between the movable contact and the stationary contact is at least greater than 50% of the total opening distance between said contacts.

4. The electric switching device according to claim 1, wherein the latching means comprise holding means for holding the conducting disk, contact-bearing support, and movable contact in the open position, the attraction force being applied via the holding means.

5. The electric switching device according to claim 1, wherein the attraction force provided by the attraction coil of the magnetic yoke is of higher intensity than the closing force provided by the biasing device.

6. The electric switching device according to claim 1, wherein the magnetic movable armature comprises a magnetic disk for location in the open position facing, and at a small distance from, a surface of the attraction coil, and in contact with the magnetic yoke.

* * * * *